United States Patent [19]

Johnston et al.

[11] 3,984,912

[45] Oct. 12, 1976

[54] METHOD FOR SPLICING CABLE

[75] Inventors: James J. Johnston, Cheshire; Henry R. Angelico; Walter J. Bedard, both of Milford; Joseph E. Ruggiero, Wallingford, all of Conn.

[73] Assignee: Automatic Equipment Development Corporation, West Haven, Conn.

[22] Filed: Feb. 28, 1975

[21] Appl. No.: 554,208

[52] U.S. Cl. ..... 29/628; 29/630 F; 174/88 R

[51] Int. Cl.[2] ..... H01R 43/00

[58] Field of Search ..... 29/628, 630 R, 630 F, 29/630 A, 629; 174/88 R, 88 S, 84 C, 94 R, 85, DIG. 8; 427/117, 120; 339/275 R, 275 C, 276 C, 276 R, 278 D, 278 C, DIG. 1

[56] References Cited

UNITED STATES PATENTS

| | | | |
|---|---|---|---|
| 2,818,363 | 12/1957 | Woolley | 29/630 A |
| 3,187,088 | 6/1965 | Warner | 174/88 R X |
| 3,243,211 | 3/1966 | Wetmore | 29/630 F |
| 3,248,253 | 4/1966 | Barford et al. | 427/25 |
| 3,717,717 | 2/1973 | Cunningham et al. | 174/73 R |
| 3,818,123 | 6/1974 | Maltz et al. | 174/88 C |

*Primary Examiner*—C.W. Lanham
*Assistant Examiner*—James R. Duzan
*Attorney, Agent, or Firm*—McCormick, Paulding & Huber

[57] ABSTRACT

Electrical wire conductors which project from two insulated cable end portions are received in tubular electrical connectors electrostatically precoated with electrical insulating material. Each precoated connector end portion respectively abuts and is sealed in engagement with insulation on an associated cable end portion. The precoated connectors are crimped into gripping engagement with the wire conductors therein to form a basic electrical splice. A tubular inner melt liner and a tubular outer sleeve of thermoplastic electrical insulating material are arranged in generally coaxially surrounding relation with the basic splice. Heat is applied to substantially simultaneously melt the inner liner and shrink the outer sleeve to encapsulate the basic splice.

7 Claims, 10 Drawing Figures

METHOD FOR SPLICING CABLE

BACKGROUND OF THE INVENTION

This invention relates in general to electrical cable splices and deals more particularly with improved encapsulated splices for electrically insulated cable and methods for making such splices.

The relatively high cost and short supply of raw materials utilized in the manufacture of insulated cable or drop wire of the type used in telephone and telegraph installations has made it economically feasible to salvage or reclaim relatively short lengths of such drop wire, as by splicing, and has created need for improved wire splices and splicing techniques. Accordingly, it is the general aim of the present invention to provide improved moisture resistant encapsulated splices which have electrical insulating characteristics equal or superior to the characteristics of the wire insulation and to provide improved methods for making such splices.

SUMMARY OF THE INVENTION

In accordance with the present invention, a method is provided for splicing two cable end portions each having a jacket of electrical insulating material containing at least one wire conductor. Insualtion is stripped from the cable end portions to expose the ends of the wire conductors therein. A coating of electrical insulating material is applied to the entire outer surfaces of a tubular electrical connector, made from electrically conductive material. Each one wire conductor is inserted into an associated end of the precoated electrical connector which is thereafter crimped into gripping engagement with the wire conductors contained therein to form a basic splice. Each end portion of the precoated connector is preferably arranged in abutting relation with an associated end portion of a cable insulating jacket and sealed in engagement therewith. A tubular inner melt liner is positioned in generally coaxially surrounding relation with the connector and a tubular outer sleeve is positioned in generally coaxial surrounding relation with the melt liner and parts of the two cable end portions adjacent the splice. Heat is applied to simultaneously melt the inner melt liner and shrink the outer sleeve to encapsulate the basic splice. In accordance with one preferred method of practicing the invention, the electrical connector is electrostatically coated with insulating material which is thereafter thermically bonded to the connector.

DETAILED DESCRIPTION OF PREFERRED EMBODIMENT AND METHOD

Figure 1:
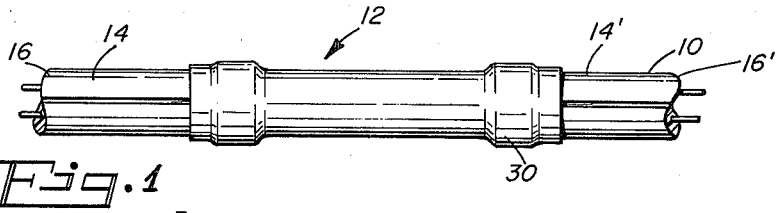
FIG. 1 is a fragmentary plan view of an electrical cable which includes a cable splice embodying the present invention and made in accordance with a method of the present invention.
Figure 2:
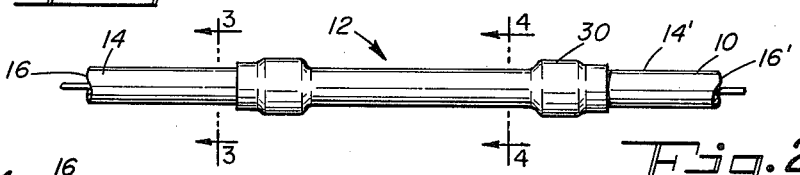
FIG. 2 is a fragmentary side elevational view of the spliced cable of FIG. 1.
Figure 3:
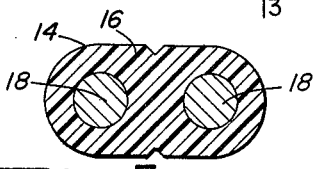
FIG. 3 is a somewhat enlarged sectional view taken along the line 3—3 of FIG. 2.
Figure 4:
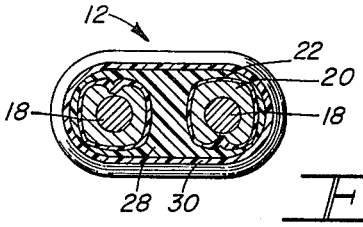
FIG. 4 is a somewhat enlarged sectional view taken along the line 4—4 of FIG. 2.
Figure 5:
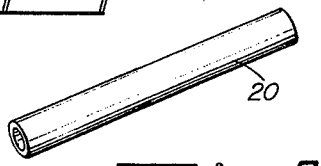
FIG. 5 is a perspective view of a tubular electrical connector used in making the cable splice illustrated in FIG. 1.
Figure 6:
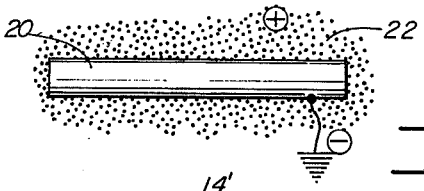
FIG. 6 is a somewhat schematic view illustrating a method for electrostatically coating the electrical connector of FIG. 5.
Figure 8:
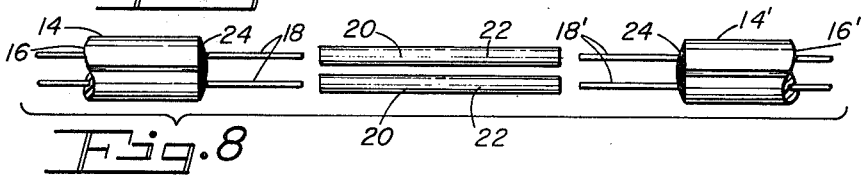
Figure 9:
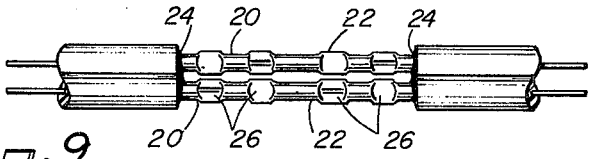

The electrically insulated splice and splicing method of the present invention may be used with any electrically insulated electrical cable which contains at least one wire conductor, as for example, a type "C" or "F" drop wire. Turning now to the drawing and referring first particularly to FIGS. 1–4, the invention is illustrated with reference to an electrical cable 10 which contains a splice, indicated generally at 12, embodying the present invention, and made in accordance with a method of the invention. The illustrated cable 10 comprises a type "F" drop wire for use in telephone installations and which has an outer jacket of polyvinyl chloride electrical insulating material and contains a pair of electrical wire conductors. The splice 12 provides insulated electrical connection between two cable end portions which for convenience in description are designated 14 and 14'. The cable end portion 14 has a jacket of electrical insulating material designated by the numeral 16 which contains wire conductors 18, 18, the end portions which project from the insulating jacket. In like manner, the cable end portion 14' has a jacket of insulating material designated 16' which contains wire conductors 18' and 18'. The end portions of the latter conductors project from the jacket 16'. Each wire conductor 18 is connected to an associated conductor 18' by a tubular electrical connector 20 made from an electrically conductive material, such as electrical copper. The entire outer surfaces of each connector 20 are covered with a coating of electrically insulating material 22, as best shown in FIG. 4. Each wire connector 18 is coaxially received in and extends for some distance into one end of an associated one of the tubular connectors 20, 20. In like manner, each conductor 18' is coaxially received in and extends for some distance into the other end of an associated one of the tubular electrical connectors 20, 20. In assembly, each end portion of each connector 20 abuts an associated end portion of one of the cable jackets 16, 16' as shown in FIG. 9, wherein a partially completed splice is illustrated. A quantity of sealing material, designated by the numeral 24 in FIGS. 8 and 9, is disposed in sealing engagement with the opposing end portions of the jacket 16, 16'. The sealing material which preferably comprises an adhesive sealant compatible with the material from which the insulating jacket is made, surrounds the associated end portions of the connectors 20, 20 which abut the jacket end portions to provide a substantial seal between each connector end portion and an associated jacket end portion which it abuts.

Each tubular connector 20 has inwardly crimped portions 26, 26 which grippingly engage the wire conductors received therein, as best shown in FIG. 4. The latter crimped portions preferably comprise confined crimps which provide positive electrical connection between the tubular connectors 20, 20 and the wire conductors 18 and 18' received therein and also impart substantial mechanical strength to the splice making it resistive to separation under longitudinal stress.

The splice 12 further includes an inner melt sleeve 28 of electrical insulating material compatible with the jacket material, which extends in an axial direction in generally surrounding sealing engagement with the connectors 20, 20 substantially filling the space therebetween. The melt sleeve 28 extends axially between the end portions of the insulating jackets 16 and 16'. An axially elongated tubular outer sleeve 30 generally closely surrounds the basic splice in sealing engagement with the inner melt sleeve 28 and an associated end portion of each of the jackets 16, 16'. The outer sleeve 30 may be made from metal or electrical insulating material, but preferably it comprises a sleeve of electrical insulating material the end portions of which are sealed in engagement with associated end portions of the insulating jackets 16 and 16'.

A method for making the splice 12 is illustrated in FIGS. 6–10 of the drawing. Each tubular electrical connector 20 is preferably electrostatically coated with a suitable electrical insulating material, as indicated somewhat schematically in FIG. 6. The electrostatic coating apparatus may, for example, comprise an electrostatic spray unit or a bath of fluidized insulating powder charged with an electrical potential different from that of the connector to be coated, such that the charge powder particles are attracted to and secured as a uniform layer over the entire outer surfaces of each conductor 20. A thermic treatment is then applied to transform the layer of powdered insulation into a continuous coating of film of electrical insulation 22. By reason of the electric charge acquired by the particles of insulating powder, the particles adhere to the conductor 20 to provide a smooth substantially uniform coating layer thereon when the conductor is brought into cooperating but spaced relationship with the bath of fluidized insulating particles. A plurality of connectors 20, 20 to be coated may, for example, be supported on pins mounted on a suitable rack which is conveyed through an electrostatic coating apparatus and thence through a suitable oven or the like wherein the powder coating is cured or thermically bonded to the connectors. The electrostatic coating process may result in deposition of a slight annular ring or coating of insulating material on the inner peripheral surface of the tubular conductor bore immediately adjacent the bore ends. However, such slight bore penetration, in the present instance, is somewhat advantageous since it cooperates with the sealant 24 to assure a high degree of sealing integrity between each connector end portion and the cable insulation which it abuts. Typical electrostatic apparatus for coating articles with fluidized powder is disclosed in U.S. Pat. No. 3,248,253 to Barford et al and in references cited therein and reference may be had to the aforementioned patent and references for further disclosure of such electrostatic coating processes.

Figure 7:
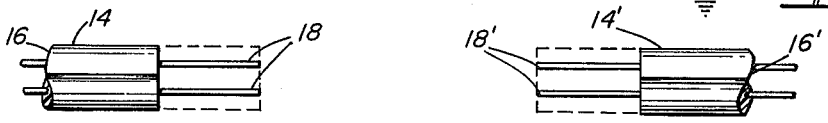
FIGS. 7–10 illustrate successive steps in a method for making the cable splice illustrated in FIGS. 1 and 2.

Further, and in accordance with the present method, insulation is stripped from the cable end portions 14 and 14' to expose end portions of the conductors 18, 18 and 18', 18' substantially as shown in FIG. 7, the stripped or removed portion of the insulation being indicated by broken lines. Preferably, and as shown, the axial length of the insulation removed from each cable end portion is approximately equal to one half the axial length of an associated connector 20. A quantity of sealing material 24 is applied to the end face of each insulating jacket 16 and 16' substantially as shown in FIG. 8. Thereafter, each wire conductor 18 is inserted into one end portion of an associated one of the connectors 20, 20 and each conductor 18' is inserted into an associated other end portion of one of the connectors 20, 20. The end portions of the connectors 20, 20 are brought into respective abutting relation with the end portions of the insulating jackets 16 and 16' substantially as shown in FIG. 9. Portions of the coated or preinsulated electrical connectors 20, 20 are then inwardly crimped into gripping engagement with the wire conductors 18, 18 and 18, 8' disposed therein to form a basic confined crimp splice, the crimped portions being designated by the numeral 26, in FIG. 9. Each connector 20 is confined within an associated crimping die set during the crimping operation, the die set having a cross-sectional area substantially equal to the cross-sectional area of the connector. The die set operates to crimp portions of the connector radially inwardly into gripping engagement with the wire conductor while restraining remaining portions of the connector against substantial outward deformation. Crimping pressure applied to the connector effects a cold weld or bond between the connector and the wire conductor therein. The several crimps in each connector are preferably made at the same time and under the same press conditions or at the same pressures to avoid risk of wire conductor breakage.

Figure 10:
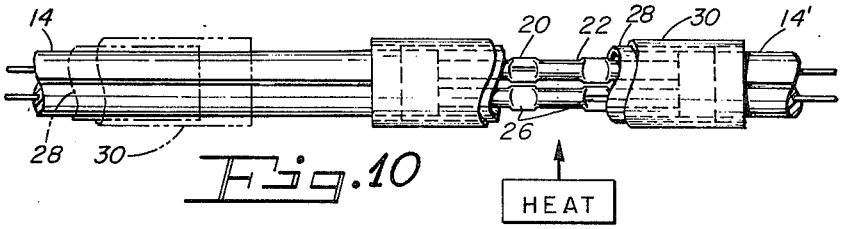

The inner tubular melt liner or sleeve 28 is positioned in generally surrounding relation to the basic splice, the connectors 20, 20 being generally axially disposed within the sleeve substantially as shown in FIG. 10. The sleeve 28 may be positioned on one of the cable end portions, as indicated in broken lines in FIG. 10, before the connectors 20, 20 are applied thereto, and moved to a position after the end portions have been joined by the conductors to form the basic splice. The sleeve 28 which melts at relatively low temperature serves as a filler and sealer to substantially fill the space between the connectors 20, 20 and provide a seal generally surrounding tubular connectors and extending axially between the opposing end portions of the insulation jackets 16, 16'. In like manner, the outer sleeve 30 is positioned to generally surround the basic splice, as shown in FIG. 10, and may, if desired, be positioned on one of the cable end portions, as indicated in broken lines in FIG. 10, before it is joined to the other cable end portions. The outer sleeve 30 may then be slid into position to surround the basic splice.

In accordance with a preferred method of practicing the invention, the outer sleeve 30 is made from heat-shrinkable insulating material compatible with the insulating jacket material. An outer sleeve of heat-shrinkable polyvinyl chloride is preferred for use with the illustrated type "F" drop wire 10. An inner melt sleeve 28 is chosen which will melt at approximately the shrink temperature of the outer sleeve 30. The inner melt sleeve 28 and the outer sleeve 30 are simultaneously positioned in coaxial surrounding relation with each other and in generally surrounding relation to the basic splice, substantially as shown in FIG. 10. Heat is simultaneously applied to the two sleeves to substantially simultaneously melt the inner melt sleeve 28 and shrink the outer sleeve 30 to encapsulate the splice. If desired, the outer sleeve 30 may have its inner peripheral surface or tubular bore coated with a suitable sealing material as, for example, a mastic material which melts when the outer sleeve is heated to its shrink temperature to seal each end portion of the outer sleeve to an end portion of an associated one of the jackets 16, 16'.

We claim:

1. A method for splicing two cable end portions, each of the cable end portions having a jacket of electrical insulation containing at least one wire conductor, said method comprising the steps of providing at least one tubular electrical connector made from electrically conductive material, coating the entire outer surfaces of said connector with electrical insulating material, stripping an end portion of the insulation jacket from each of the two cable end portions to expose an end face of each insulation jacket and an end portion of each one wire conductor, applying sealing material to the exposed end face of each insulation jacket, inserting each one wire conductor into an associated end portion of the one coated electrical connector to bring each end portion of the one connector into generally abutting and sealing engagement with an end face of an associated cable jacket to which sealing material has been applied, crimping portions of the one coated electrical connector inwardly and into gripping engagement with each one wire conductor disposed therein whereby to form a basic splice which includes the one connector and an end portion of each of the two jackets sealed in abutting relation with the ends of the one connector, positioning a tubular melt sleeve in generally coaxial surrounding relation with the basic splice, and applying heat to melt said melt sleeve into surrounding sealing engagement with the basic splice.

2. A method for splicing two cable end portions as set forth in claim 1 wherein the step of coating said connector is further characterized as electrostatically coating the entire outer surfaces of said connector with electrical insulating material.

3. A method for splicing two cable end portions as set forth in claim 2 wherein the step of coating said connector is further characterized as a electrostatically coating said connector with powdered electrical insulating material and including the additional step of thermically treating the coated connector to bond the said insulating material to the entire outer surfaces thereof.

4. A method for splicing two cable end portions as set forth in claim 1 including the additional step of positioning a tubular outer sleeve of deformable material to generally coaxially surround said said melt sleeve and associated end portions of the insulation jackets adjacent the ends of said melt sleeve and deforming the outer sleeve inwardly into generally sealing engagement with the melt sleeve and the associated end portions of the insulation jackets adjacent the ends of said melt sleeve.

5. A method of splicing two cable end portions as set forth in claim 1 including the additional step of positioning a heat-shrinkable tubular outer sleeve in generally coaxial surrounding relation with said melt sleeve and the step of applying heat is further characterized as simultaneously applying heat to said outer heat-shrinkable sleeve and said melt sleeve to substantially simultaneously melt said melt sleeve into surrounding sealing engagement with said basic splice and shrink said outer heat shrinkable sleeve into sealing engagement with said melt sleeve and an associated end portion of the insulating jacket on each of said cable end portions.

6. A method for splicing two cable end portions as set forth in claim 1 wherein the step of crimping is further characterized as simultaneously crimping axially spaced portions of the coated electrical connector inwardly while said connector is confined within a crimping die set to apply pressures to said connector sufficient to effect a cold weld between said connector and each one wire conductor received within said connector.

7. A method for splicing two cable end portions, each of the cable end portions having a jacket of electrical insulation containing at least one wire conductor, said method comprising the steps of providing at least one tubular electrical connector made from electrically conductive material, electrostatically coating the entire outer surfaces of said connector with powdered electrical insulating material, thermically treating the electrostatically coated conductor to bond said electrical insulating material to the entire outer surfaces thereof, stripping an end portion of the insulation jacket from each of the two cable end portions to expose an end face of each insulation jacket and an end portion of each one wire conductor, applying sealing material to the exposed end face of each insulation jacket, inserting each one wire conductor into an associated end portion of said one coated electrical connector to bring each end portion of said one connector into generally abutting and sealing engagement with an end face of an associated cable jacket to which sealing material has been applied, simultaneously crimping axially spaced portions of said coated electrical connector inwardly and into gripping engagement with each one wire conductor disposed therein while said connector is confined within a crimping die set to apply pressures to said connector sufficient to effect a cold weld between said connector and each one wire conductor received in said connector whereby to form a basic splice which includes said one connector and an end portion of each of the two jackets sealed in abutting relation with the ends of said one connector, positioning a tubular melt sleeve in generally coaxial surrounding relation with the basic splice, positioning a heat-shrinkable tubular outer sleeve in generally coaxial surrounding relation with said melt sleeve, and simultaneously applying heat to said heat-shrinkable outer sleeve and said melt sleeve to substantially simultaneously melt said melt sleeve into surrounding sealing engagement with said basic splice and shrink said heat-shrinkable outer sleeve into sealing engagement with said melt sleeve and an associated end portion of the insulating jacket on each of said cable end portions.

* * * * *